US007941901B2

(12) United States Patent
Saeger et al.

(10) Patent No.: US 7,941,901 B2
(45) Date of Patent: May 17, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventors: Nicole Saeger, Aachen (DE); Johannes Bossmann, Mönchengladbach (DE); Thomas Schmitz, Mönchengladbach (DE)

(73) Assignee: Trützschler GmbH & Co. KG, Möchengladbach (DE)

( * ) Notice: Subject to any disclaimer, the term of this patent is extended or adjusted under 35 U.S.C. 154(b) by 382 days.

(21) Appl. No.: 12/163,567

(22) Filed: Jun. 27, 2008

(65) Prior Publication Data

US 2009/0000072 A1 Jan. 1, 2009

(30) Foreign Application Priority Data

Jun. 29, 2007 (DE) ..... 10 2007 030 471
Jun. 29, 2007 (DE) ..... 20 2007 010 686 U
Aug. 15, 2007 (DE) ..... 10 2007 038 667
Jan. 11, 2008 (DE) ..... 10 2008 004 095

(51) Int. Cl.
*D01G 19/00* (2006.01)

(52) U.S. Cl. ..... 19/217

(58) Field of Classification Search ..... 19/115 R, 19/128, 215, 216, 217
See application file for complete search history.

(56) References Cited

U.S. PATENT DOCUMENTS 1,408,780 A * 3/1922 Schleifer ..... 19/217
1,425,059 A * 8/1922 Schleifer ..... 19/217
1,694,432 A * 12/1928 Schleifer ..... 19/217
1,708,032 A * 4/1929 Schleifer ..... 19/217
1,715,473 A * 6/1929 Schleifer ..... 19/217
1,799,066 A * 3/1931 Schleifer ..... 19/217
2,044,460 A * 6/1936 Bartram et al. ..... 19/99
2,962,772 A 12/1960 Draving et al.
3,108,333 A * 10/1963 Schleifer ..... 19/235
4,270,245 A 6/1981 Stewart et al.
5,007,623 A 4/1991 Unkuri et al.

(Continued)

FOREIGN PATENT DOCUMENTS

DE 367482 C 1/1923

(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner* — Shaun R Hurley
(74) *Attorney, Agent, or Firm* — Venable LLP; Robert Kinberg; Steven J. Schwarz

(57) ABSTRACT

In an apparatus for fiber-sorting or fiber-selection of a fiber bundle comprising textile fibers, especially for combing, the fiber bundle is supplied to a fiber-sorting device, clamping devices are provided, which clamp the fiber bundle at a distance from its free end, and mechanical device is present, which generates a combing action from the clamping site to the free end of the fiber bundle. To increase productivity in a simple manner and obtain an improved combed sliver downstream of the supply device there are at least two rotatably mounted rollers rotating rapidly without interruption, the combing device are associated with a said roller, and an arrangement for optimum feed and/or positioning of the fiber material to be combed is associated with the combing device.

23 Claims, 11 Drawing Sheets

U.S. PATENT DOCUMENTS

| | | | | |
|---|---|---|---|---|
| 5,343,686 | A | 9/1994 | Buchner et al. | |
| 5,404,619 | A | 4/1995 | Jorg | |
| 5,457,851 | A | 10/1995 | Mondini | |
| 5,502,875 | A | 4/1996 | Stolz et al. | |
| 5,796,220 | A | 8/1998 | Clapp et al. | |
| 6,163,931 | A | 12/2000 | Leifeld | |
| 6,173,478 | B1 | 1/2001 | Patelli et al. | |
| 6,216,318 | B1 | 4/2001 | Leifeld | |
| 6,235,999 | B1 | 5/2001 | Rubenach | |
| 6,295,699 | B1 | 10/2001 | Temburg | |
| 6,499,194 | B1 | 12/2002 | Gresser et al. | |
| 6,611,994 | B2 | 9/2003 | Bischofberger et al. | |
| 7,173,207 | B2 | 2/2007 | Losbrock et al. | |
| 2002/0124354 | A1 | 9/2002 | Pferdmenges et al. | |
| 2003/0005551 | A1* | 1/2003 | Schurenkramer et al. | 19/107 |
| 2003/0029003 | A1* | 2/2003 | Breuer et al. | 19/98 |
| 2003/0070260 | A1 | 4/2003 | Rubenach | |
| 2003/0154572 | A1* | 8/2003 | Pferdmenges et al. | 19/98 |
| 2004/0040121 | A1* | 3/2004 | Schmitz | 19/98 |
| 2004/0128799 | A1* | 7/2004 | Hosel et al. | 19/98 |
| 2005/0076476 | A1 | 4/2005 | Temburg | |
| 2005/0198783 | A1 | 9/2005 | Rubenach | |
| 2005/0278900 | A1 | 12/2005 | Dammig | |
| 2006/0260100 | A1 | 11/2006 | Duda et al. | |
| 2007/0180658 | A1* | 8/2007 | Saeger et al. | 19/98 |
| 2007/0180659 | A1* | 8/2007 | Saeger et al. | 19/98 |
| 2007/0180660 | A1* | 8/2007 | Saeger et al. | 19/98 |
| 2007/0266528 | A1 | 11/2007 | Farber et al. | |
| 2008/0092339 | A1 | 4/2008 | Bossman et al. | |
| 2009/0000064 | A1 | 1/2009 | Saeger et al. | |
| 2009/0000065 | A1 | 1/2009 | Saeger et al. | |
| 2009/0000066 | A1 | 1/2009 | Saeger et al. | |
| 2009/0000067 | A1* | 1/2009 | Leder et al. | 19/115 R |
| 2009/0000068 | A1* | 1/2009 | Saeger et al. | 19/115 R |
| 2009/0000069 | A1 | 1/2009 | Saeger et al. | |
| 2009/0000070 | A1 | 1/2009 | Saeger et al. | |
| 2009/0000071 | A1 | 1/2009 | Saeger et al. | |
| 2009/0000073 | A1 | 1/2009 | Saeger et al. | |
| 2009/0000074 | A1 | 1/2009 | Bossmann | |
| 2009/0000075 | A1* | 1/2009 | Saeger et al. | 19/115 R |
| 2009/0000076 | A1 | 1/2009 | Bossmann et al. | |
| 2009/0000077 | A1 | 1/2009 | Saeger et al. | |
| 2009/0000078 | A1 | 1/2009 | Saeger et al. | |
| 2009/0000079 | A1 | 1/2009 | Bossmann | |

FOREIGN PATENT DOCUMENTS

| | | | |
|---|---|---|---|
| DE | 382169 | C | 9/1923 |
| DE | 399885 | C | 7/1924 |
| DE | 489 420 | C | 1/1930 |
| DE | 30 48 501 | A1 | 7/1982 |
| DE | 103 20 452 | A1 | 11/2004 |
| EP | 1 586 682 | A1 | 10/2005 |
| WO | WO-2006/012758 | A1 | 2/2006 |

OTHER PUBLICATIONS

German Patent Office Search Report, dated Oct. 20, 2006, Issued in related German Patent Application No. 10 2006 050 453.4, and partial English-language translation.

U.S. Office Action dated Feb. 26, 2010, issued in related U.S. Appl. No. 12/149,506.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

The present application claims priority from German Utility Model Application No. 20 2007 010 686.6 dated Jun. 29, 2007, German Patent Application No. 10 2007 038 667.4 dated Aug. 15, 2007, and German Patent Application No. 10 2008 004 095.9 dated Jan. 11, 2008, the entire disclosure of each of which is incorporated herein by reference.

BACKGROUND OF THE INVENTION

The invention relates to an apparatus for the fibre-sorting or fibre-selection of a fibre bundle comprising textile fibres, especially for combing.

In a known apparatus, fibre material is supplied by means of a supply device to a fibre-sorting device, especially to a combing device, in which clamping devices are provided, which clamp the fibre bundle at a distance from its free end and mechanical means are present which generate a combing action from the clamping site to the free end of the fibre bundle in order to loosen and remove non-clamped constituents, such as, for example, short fibres, neps, dust and the like from the free end.

In practice, combing machines are used to free cotton fibres or woollen fibres of natural impurities contained therein and to parallelise the fibres of the fibre sliver. For that purpose, a previously prepared fibre bundle is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre bundle and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit, which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre tuft supplied by the nipper assembly, a top comb and a fixed-position detaching device for detaching the combed-out fibre tuft from the nipper assembly. The nipper assembly comprises a lower nipper, which co-operates with an upper nipper plate. The upper nipper plate is here pivotally mounted on the lower nipper by way of a pivot axis. The lower nipper and the upper nipper are formed with complementary profiles at their front end region, via which, when the nipper assembly is closed, they clamp the lap supplied via a feed cylinder. The fibre tuft FB protruding in this clamped position from the nipper assembly is combed by a comb segment of a circular comb. The circular comb arranged beneath the nipper assembly is secured, without relative rotation, on a circular comb shaft, which is connected via the drive connection to the gear mechanism. The drive of the gear mechanism is effected by a main motor. The nipper assembly is pivotally mounted on the axis of the circular comb shaft via a pivot arm. The free end of the pivot arm is fixedly secured to the frame of the lower nipper. In its rear region, the lower nipper has a pivot axis, on which a lever is rotatably mounted. This lever is rotatably secured via an axle to a crank disc. The axle of the crank disc is in connection via a drive connection with a drive motor. The motor is in connection with the central control unit via the control line. In order to co-ordinate the electromotive drives with the drive of the circular comb, a sensor is provided, which is in connection with the control unit via the line. The function of this sensor is to detect the particular angular position of the shaft of the circular comb and relay this to the control unit. It is thus possible to output appropriate control pulses to the relevant motors via the control unit, so that, on the one hand, the combing segment combs out the fibre tuft FB at a defined point in time and, on the other hand, the rotary movement of the detaching roller pair respectively the transport roller pair is co-ordinated with the nipper movement. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited. The rotational speed of the circular comb is co-ordinated with the slow (discontinuous) combing process, in particular the discontinuous and slow movements of the nippers, and is limited by this. In addition, the profiled end regions of the upper and lower nipper suffice for the feed respectively positioning at slow speed of the fibre tuft to be combed out. High-speed combing with this apparatus is not possible.

SUMMARY OF THE INVENTION

It is an aim of the invention to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having:

a fibre-sorting device having clamping devices for clamping a fibre bundle;

a supply device for supplying the fibre bundle to the fibre-sorting device; and at least one mechanical device for generating a combing action in order to loosen and remove non-clamped constituents from the fibre bundle;

wherein the fibre-sorting device comprises, arranged downstream of the supply device, at least first and second rotatably mounted rollers that, in use, rotate rapidly without interruption, at least said second roller having clamping devices distributed spaced apart in the region of its periphery, the device for generating a combing action is associated with said second roller, and a positioning arrangement for optimum feed and/or positioning of the fibre material to be combed is associated with the at least one device for generating a combing action.

By implementing the functions of clamping and moving the fibre bundles to be combed-out on rotating rollers, high operating speeds (nip rates) are achieved—unlike the known apparatus—without large mass accelerations and reversing movements. In particular, the mode of operation is continuous. When high-speed rollers are used, a very substantial increase in hourly production rate (productivity) is achieved which had previously not been considered possible in technical circles. A further advantage is that the rotary rotational movement of the roller with the plurality of clamping devices leads to an unusually rapid supply of a plurality of fibre bundles per unit of time to the first roller and to the second roller. In particular the high rotational speed of the rollers allows production to be substantially increased.

To form the fibre bundle, the fibre sliver pushed forward by the feed roller is clamped at one end by a clamping device and detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the turning rotor onto the combing rotor the ends of the fibre bundle are reversed: the clamping device on the combing rotor grips and clamps the end with the long fibres, so that the region with the short fibres projects from the clamping device and lies exposed and can thereby be combed out.

The fibre bundles are—unlike the known apparatus—held by a plurality of clamping devices and transported under rotation. Because a plurality of clamping devices is available for the fibre bundles, in an especially advantageous manner fibre bundles can be supplied to the first and second roller respectively one after the other and in quick succession, without undesirable time delays resulting from just a single supply device for each clamping device. Advantageously, the fibre bundles supplied to the rollers are additionally acted upon by suction for support. Here, the free end of the fibre bundles is gripped very quickly and drawn into the clamping device whilst the clamping device is open, which leads to a further considerable increase in production speed. The suction air currents advantageously have an influence on the alignment and movement of the fibre bundles to be transported. A particular advantage is that, owing to the high-speed rollers, a plurality of fibre slivers can be combed out by the combing elements in a very short time. For that purpose, means, for example, pneumatic and/or mechanical means, are associated with the combing elements for optimum feed and/or positioning of the fibre material to be combed. Through the rotary arrangement of the clamping devices on a high-speed roller that rotates without interruption, it is possible to supply a plurality of fibre bundles in a short time to just a few combing elements. A considerable structural simplification is thereby implemented.

Advantageously, a guide device is present for feed and/or positioning. The guide device may be, in certain embodiments, a pneumatic guide device. For example, the guide means comprise a suction device, or the guide means comprise a blowing device. In other embodiments, a mechanical guide device may be present.

Advantageously, there are fewer combing elements than clamping elements which co-operate with the combing elements. In some embodiments the device for combing is associated with the periphery of the combing rotor. In other embodiments, the device for combing is arranged at and opposite the periphery of the combing rotor. In yet further embodiments, the device for combing is arranged opposite and spaced from the periphery of the combing rotor. In certain embodiments, additional elements, e.g. for optimum fibre bundle feed, are integrated in the combing rotor.

Advantageously, the distance of the device for combing from the combing rotor is adjustable. Advantageously, a fibre bundle separated from the fibre lap is fed to the device for combing. Advantageously, on feed to the device for combing the fibre bundle is stationary in relation to the clamping site on the combing rotor. Advantageously, the clamped fibre bundle moves in rotation around the rotor axis in the direction of flow of the material. Advantageously, a plurality of devices for combing are arranged in succession in the direction of flow of the material. Advantageously, a plurality of devices for combing the fibre bundle are present, the spacing of the combing elements in the direction of flow of the material being variable. Preferably, the spacing of the combing elements in the direction of flow of the material becomes continuously smaller. In some embodiments, the combing elements are circular combs. In other embodiments, the combing elements are rollers. In yet further embodiments, the combing elements are endlessly revolving combing elements (revolving card flats). Advantageously, the device for combing is rotatably mounted axially parallel with respect to the combing rotor. Advantageously, with respect to the circulation as a whole, the circulating combing elements are positionable with a constant spacing from the combing rotor. In some embodiments, the circulating combing elements are positionable in the direction of flow of the material-with respect to the circulation as a whole in a wedge shape, e.g. with an increasingly smaller spacing from the combing rotor. For example, the individual elements (combing elements) may have a positive offset or, instead, the individual elements (combing elements) may have a negative offset.

In some embodiments, the narrow point in respect of the combing rotor is positionable in the middle of the individual element (combing element). In certain embodiments, the individual elements (combing elements) are of straight construction. In other embodiments, the individual elements (combing elements) have a curved geometry corresponding to the diameter of the combing rotor, so that a constant combing nip is ensured over the circulation as a whole. In some embodiments, the direction of rotation of the combing elements is effected in the same direction as the combing rotor. In other embodiments, the direction of rotation of the combing elements is effected opposite to the direction of the combing rotor. Advantageously, the speed of circulation of the combing elements is adjustable. Advantageously, the productivity of the rotor combing machine is independent of the relative speed between combing element and fibre bundle.

Where the directions of rotation of the combing elements and the combing rotor are the same the speed ratio between the speed of the combing rotor and the speed of the combing element is advantageously greater than 1. Where the directions of rotation of the combing elements and the combing rotor are opposite, the speed ratio between combing rotor and combing elements is advantageously greater than 1. It may be preferred, however, that with opposite directions of rotation the speed ratio between combing rotor and combing elements is less than 1, or is equal to 1.

Where a plurality of devices is used for combing the fibre bundle, to achieve an optimum combing result the directions of rotation of the combing elements and the speed ratios can advantageously be selected to be different. Advantageously, as final combing-out step, the combing element is operable in counter direction, in order to re-comb the already pre-cleaned fibre bundle intensively.

Advantageously, when using e.g. a circular comb as combing element, a stripper element, a cover element, a holding-down element or the like can be used, wherein the useful combing length is adjustable in a defined manner. Preferably the stripper element, the cover element, the holding-down member or the like are exchangeable and adjustable in their position with respect to the combing element.

Advantageously, the surface of the combing element comprises an all-steel clothing. In some embodiments, the surface of the combing element comprises flexible clothings. In other embodiments, the surface of the combing element comprises needles. Advantageously, when configuring the surface, fully clothed surfaces can be used, e.g. clothed circular comb rollers. Advantageously, clothed segments that cover the entire surface can be used on the surface of the combing element. If desired, clothed segments that cover only a part of the surface can be used on the surface. In certain embodiments, the segments may be mounted on the surface in a wedge form. In other embodiments, clothings having a continuously increasing height can be used. Advantageously, when using a plurality of devices for combing the fibre bundle, surfaces on the combing elements that are different in respect of the tip density can be used. Advantageously, when using a plurality of devices for combing the fibre bundle, surfaces on the combing elements that are different in respect of the working angle can be used. Advantageously, when using a plurality of devices for combing the fibre bundle, surfaces on the combing elements that are different in respect of clothing height can be used.

In some embodiments, for optimum feed of the fibre bundle to the combing element, an air jetting (compressed air jet or compressed air jets) from the combing rotor is effected. Advantageously, the air jetting pressure is adjustable. Advantageously, the air jetting angle is adjustable. Advantageously, the position of the nozzles is adjustable.

In other embodiments, for optimum feed of the fibre bundle to the combing element, an externally mounted nozzle arrangement is present.

Advantageously, the air jetting pressure/or the air jetting angle and/or the position of the nozzles of the externally mounted nozzle arrangement are adjustable.

In further embodiments, an optimum feed of the fibre bundle to the combing element is effected by the nipper geometry of the combing rotor nippers, wherein a mechanical guidance is present.

In yet further embodiments, an optimum feed of the fibre bundle to the combing element is effected by guide elements at the periphery of the combing rotor, wherein a mechanical guidance is implemented.

Advantageously, the spacing and/or the position of the guide elements with respect to the combing rotor is adjustable. In some embodiments, guide elements retractable into the combing rotor (retraction during the combing process) are present.

Advantageously, for optimum feed of the fibre bundle to the combing element, the combing element (e.g. cylindrical surface) and/or clothing has air outlet openings and is connected to a source of reduced pressure. In some embodiments, the cylindrical surface of the combing element may have air passage openings. In other embodiments, the clothing that is positioned on the cylindrical surface of the combing element, comprises e.g. a profiled clothed foot, which is air permeable. In yet further embodiments, the clothed segments comprise a profiled foot, in order to be air permeable. When using clothed segments the air passage openings may be located, for example, between the individual segments. When using flexible clothings the card top material, that is the base, may be perforated. Advantageously, the reduced pressure is adjustable. The combing element may be continuously acted upon by suction or may instead be acted upon by suction on a timed basis.

Advantageously, a portion of the inner cylindrical surface of the take-off roller is sealable by a screen element. Advantageously, the spacing of the screen elements from the combing element in the radial direction is small. The spacing of the screen elements from the combing element may amount to, for example, 0 mm, e.g. when using slide seal rings.

Advantageously, a cleaning device is associated with the combing element. Advantageously, the cleaning device is a rotating roller. Preferably, the roller has wires, bristles or the like on its periphery. Preferably, the cleaning device includes an extraction device. Preferably, the cleaning device includes a stripper, scraper or the like.

In some embodiments, the cleaning is designed analogously to the cleaning of the card top circulation of a card. In other embodiments, the cleaning is designed analogously to the cleaning of a circular comb. In yet further embodiments, the cleaning is designed analogously to the cleaning of a stripping roller. Preferably, a cleaning device is capable of cleaning at least two combing elements.

In certain preferred embodiments, the at least two rotatably mounted rollers that run rapidly without interruption comprise a turning rotor and a combing rotor. Preferably, the turning rotor and the combing rotor have opposite directions of rotation. Advantageously, for the suction of the supplied bundles, at least one suction device is associated with the clamping devices in the region of the take-up of the fibre bundle from the supply device to the to the first roller and/or in the region of the transfer of the fibre material from the first roller to the second roller.

The invention also provides an apparatus for the fibre-sorting or fibre-selection of a fibre bundle comprising textile fibres, especially for combing, which is supplied by means of a supply device to a fibre-sorting device, especially a combing device, in which clamping devices are provided which clamp the fibre bundle at a distance from its free end, and mechanical means are present which generate a combing action from the clamping site to the free end of the fibre bundle, in order to loosen and remove non-clamped constituents, such as, for example, short fibres, neps, dust and the like from the free end, characterised in that that downstream of the supply device there are arranged at least two rotatably mounted rollers rotating rapidly without interruption which is provided with clamping devices for the fibre bundle transported in rotation, which clamping devices are distributed spaced apart in the region of the periphery of at least one of said rollers, and the means for generating a combing action (combing elements) are associated with a said roller, wherein means for optimum feed and/or positioning of the fibre material to be combed are associated with the means for generating a combing action.

DETAILED DESCRIPTION OF CERTAIN PREFERRED EMBODIMENTS

Figure 1:
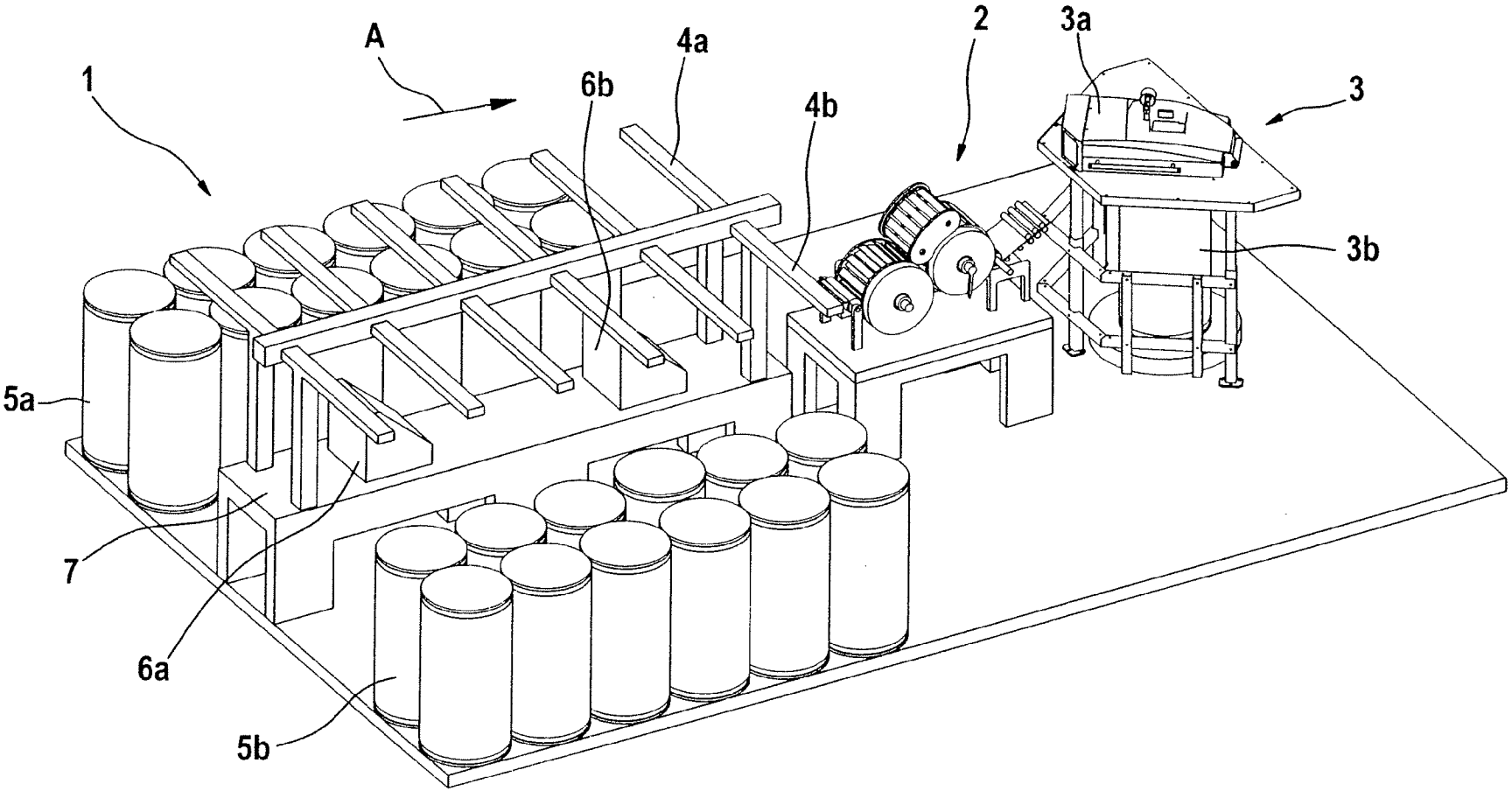
FIG. 1 is a diagrammatic perspective view of a device for combing fibre material, comprising a combing preparation device, a rotor combing machine and a sliver-deposition device.

With reference to FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) are doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel, forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The comber sliver is thereby drafted.

In accordance with a further construction, more than one rotor combing machine 2 is provided. If, for example, two rotor combing machines 2*a* and 2*b* are present, then the two delivered comber slivers 17 can pass together through the downstream autoleveller drafting system 50 and be deposited as a drafted comber sliver in the sliver-deposition device 3.

The sliver-deposition device 3 comprises a rotating coiler head 3*a*, by which the comber sliver can be deposited in a can 3*b* or (not shown) in the form of a can-less fibre sliver package.

Figure 2:
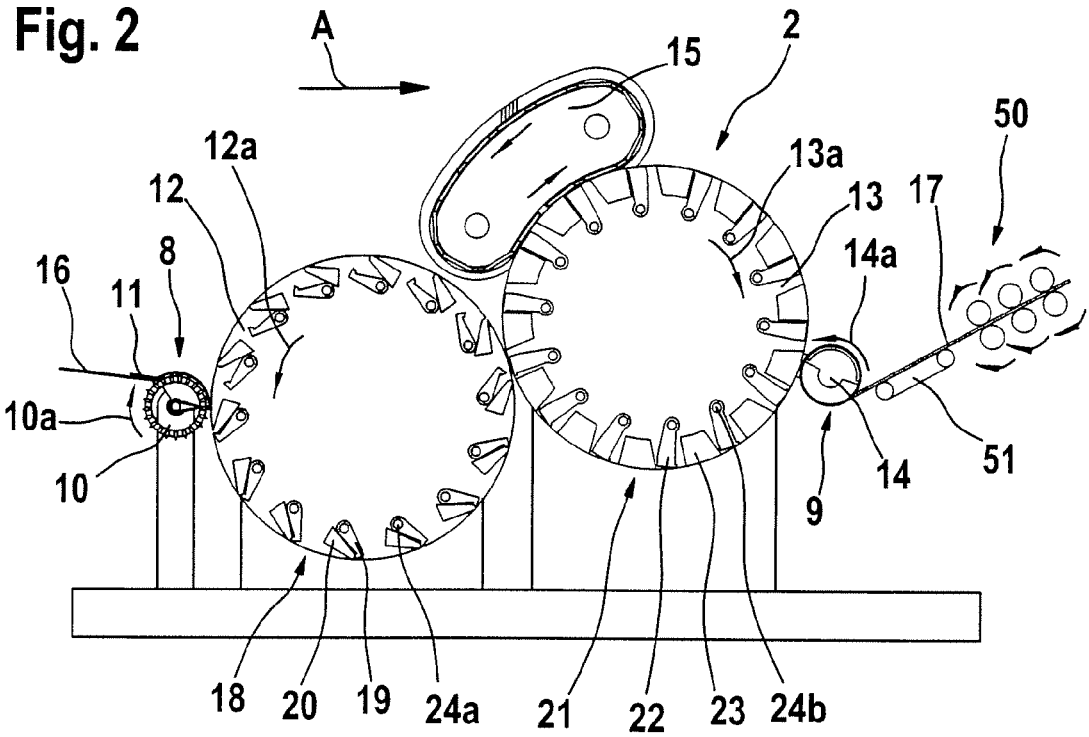
FIG. 2 is a diagrammatic side view of a rotor combing machine according to the invention having two rollers.

FIG. 2 shows a rotor combing machine 2 having a supply device 8 comprising a feed roller 10 and a feed tray 11, having a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a* (see FIG. 11), which is attached to the roller 12. The lower nipper 20 is mounted on the roller 12 so as to be either fixed or movable. The free end of the upper nipper 19 faces the periphery of the roller 12. The upper nipper 19 and the lower nipper 20 co-operate so that they are able to grip a fibre bundle 16, $\mathbf{30}_1$, $\mathbf{30}_2$ (clamping) and release it (FIG. 12*a* to 12*c*).

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b* (see FIG. 11), which is attached to the roller 13. The lower nipper 23 is mounted on the roller 13 so as to be either fixed (see FIG. 8) or movable (see FIG. 11). The free end of the upper nipper 22 faces the periphery of the roller 13. The upper nipper 22 and the lower nipper 23 co-operate so that they are able to grip a fibre bundle $\mathbf{30}_2$, $\mathbf{30}_3$ (clamping) and release it (FIG. 8; 10*a*, 10*b*; 12*c*, 12*d*). In the case of roller 12, around the roller periphery between the feed roller 10 and the second roller 13 the clamping devices 18 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. Reference numeral 51 denotes a driven ascending conveyor, for example a conveyor belt. It is also possible to use an upwardly inclined metal sheet or the like for conveying purposes.

Figure 3:
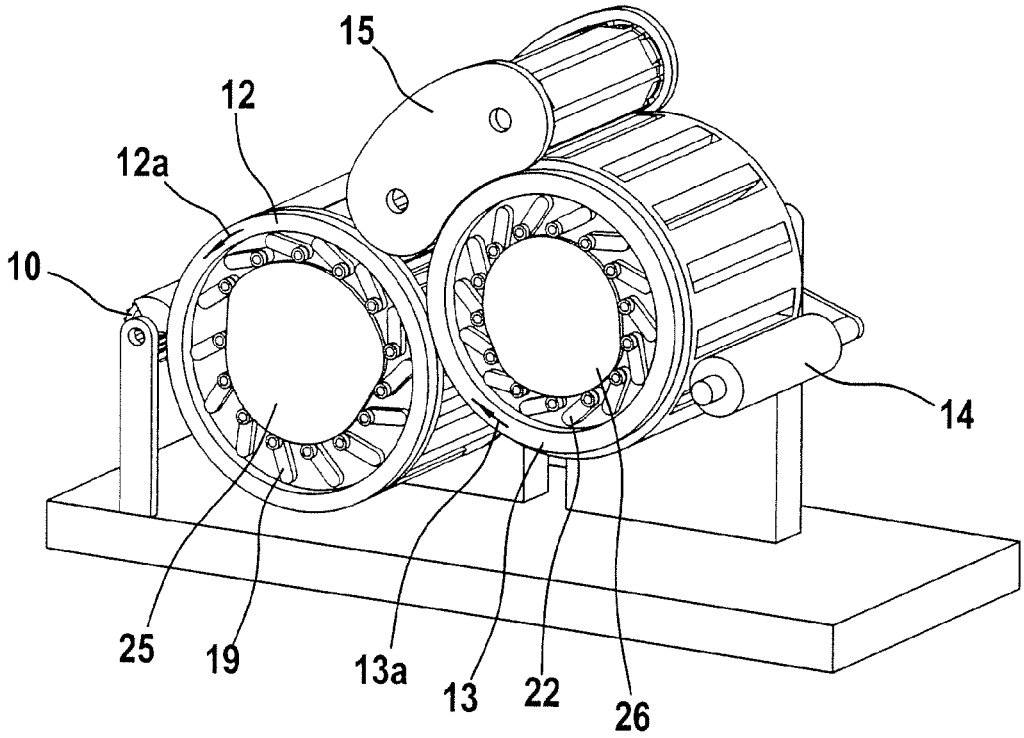
FIG. 3 is a perspective view of a rotor combing machine according to FIG. 2 having two cam discs.

In an embodiment shown in FIG. 3, two fixed cam discs 25 and 26 are provided, about which the roller 12 having the first clamping devices 18 and the roller 13 having the second clamping device 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26, the upper nippers 19 and 22 are rotated about pivot axes 24*a* and 24*b*, respectively. In that way, the opening and closing of the first clamping devices 18 and the second clamping devices 21 is implemented.

Figure 4:
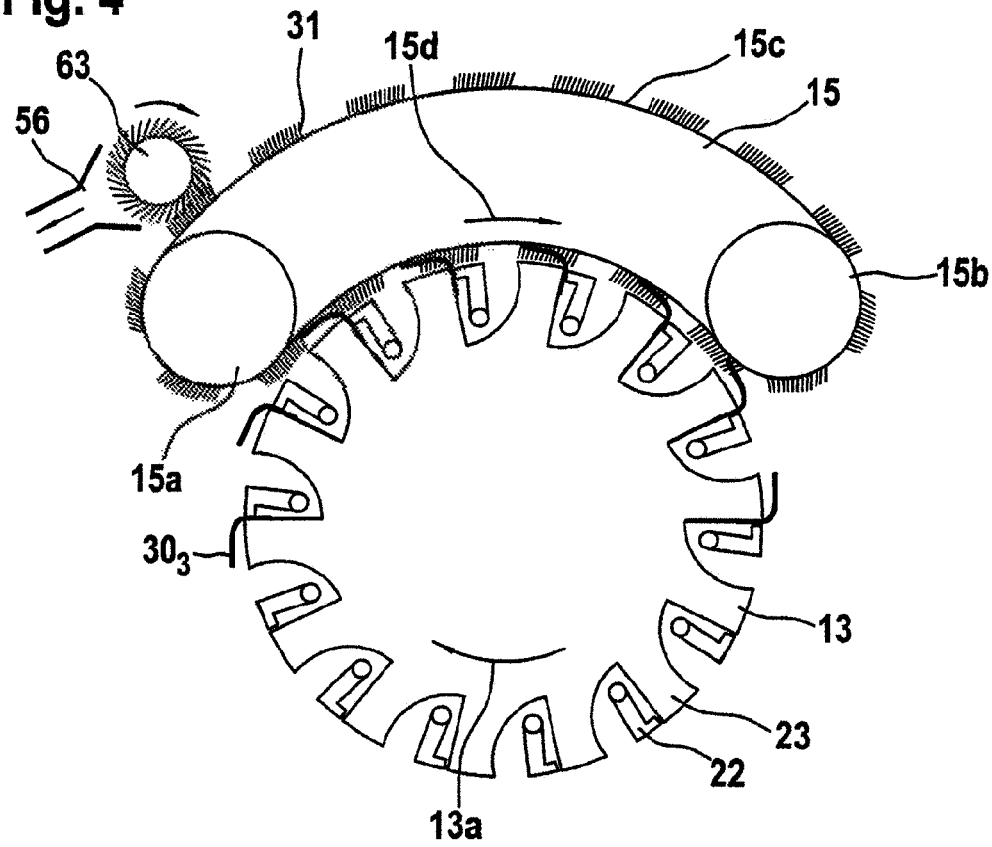
FIG. 4 is a side view of the second roller (combing roller) of a rotor combing machine with clamping devices and revolving card top assembly for combing elements.
Figure 5:
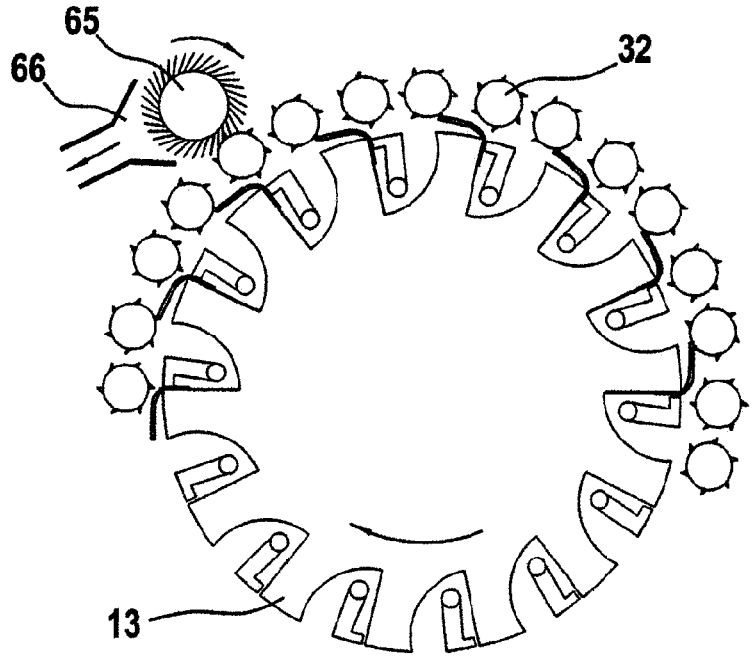
FIG. 5 is a side view of a second roller (combing roller) of another rotor combing machine with clamping devices and circular comb (comb rollers) as combing elements.

In the embodiment of FIG. 4, the fibre bundles $\mathbf{30}_3$ are clamped at one end by some of the clamping devices 21 between the upper nipper 22 and the lower nipper 23, that is to say at a distance from their free end. The fibre bundles $\mathbf{30}_3$ are then bent over in the direction of their free ends, the free end regions of the fibre bundles $\mathbf{30}_3$ each being directed against the direction of rotation 13*a*. The revolving top combing assembly 15 consists of a flexible belt element 15*c* endlessly revolving around two guide rollers 15*a* and 15*b* and having a plurality of combing elements 31 mounted on its outer side. The free ends of the combing teeth 33 of the combing elements 31 point in the direction away from the belt element 15*c*. The combing elements 31 are arranged in the combing-out region at a distance from the periphery of the roller 13. In the combing-out region, the direction of movement 15*d* of the belt element 15*c* and the direction of movement 13*a* of the roller 13 are the same, that is to say same-direction operation applies. The speeds of the belt element 15*c* having the combing elements 31 on the one hand and of the roller 13 having the clamping elements 21, including the sliver bundles $\mathbf{30}_3$, are different, however, that is to say a relative speed applies. The circumferential speed of the roller 13 in the operating region (combing region) is greater than the speeds of movement of the combing elements 31.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a* (see FIG. 11), which is attached to the roller 12. The lower nipper 20 is mounted on the roller 12 so as to be either fixed or movable. The free end of the upper nipper 19 faces the periphery of the roller 12. The upper nipper 19 and the lower nipper 20 co-operate so that they are able to grip a fibre bundle 16 (clamping) and release it.

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b* (see FIG. 11), which is attached to the roller 13. The lower nipper 23 is mounted on the roller 13 so as to be either fixed (see FIG. 8) or movable (see FIG. 11). The free end of the upper nipper 22 faces the periphery of the roller 13. The upper nipper 22 and the lower nipper 23 co-operate so that they are able to grip a fibre bundle $\mathbf{30}_3$ (clamping) and release it (FIG. 8; 10*a*, 10*b*; 12*c*, 12*d*). In the case of roller 12, around the roller periphery between the feed roller 10 and the second roller 13 the clamping devices 18 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. Reference numeral 51 denotes a driven ascending conveyor, for example a conveyor belt. It is also possible to use an upwardly inclined metal sheet or the like for conveying purposes.

Figure 6:
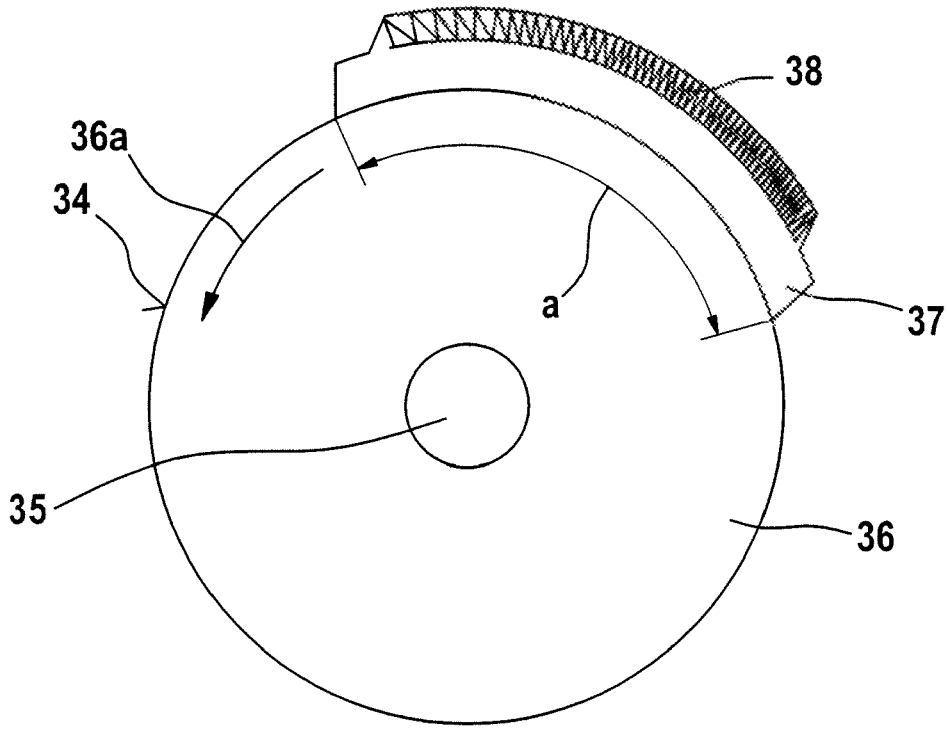
FIG. 6 is a diagrammatic side view of a circular comb.

FIG. 6 shows a circular comb 34, in which a circular comb carrier 36 is mounted, secured against rotation, on a circular comb shaft 35 by fixing means (not shown). A base plate 37 is secured via fixing means (not illustrated) to the outer surface of the circular comb carrier 36. Differently constructed rows of toothed clothings 38 are mounted on the base plate 37. The toothed clothings 38, e.g. saw-tooth wire strips (all-steel clothings) collectively form a combing segment. The toothed clothings 38 are secured to the base plate either by adhesion or by positive connection. The circular comb 34 rotates in direction 36*a*. The combing elements 31 (see FIG. 4) can be correspondingly constructed. The toothed clothings 38 are convexly oriented.

Figure 7:
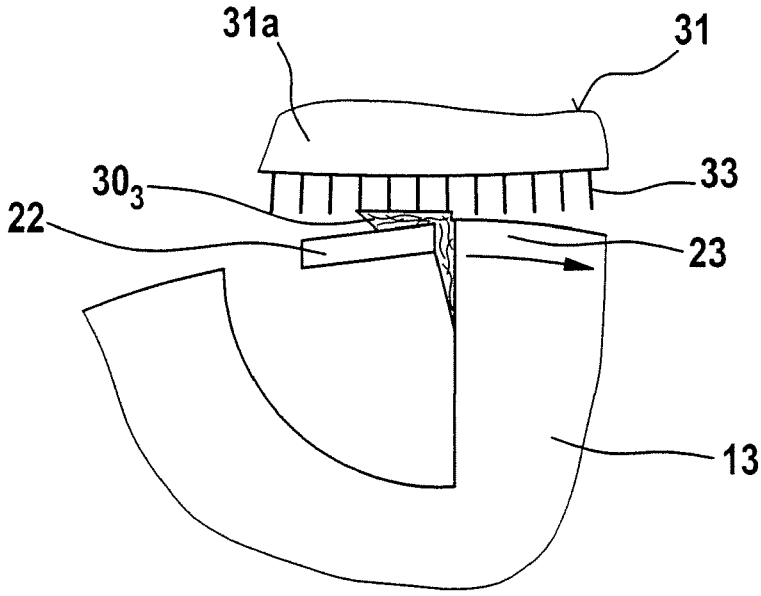
FIG. 7 shows diagrammatically the combing of a fibre bundle through motive engagement with the combing element.

In the embodiment of FIG. 7, the combing element 31 has a support element 31*a*, on which or in which the comb teeth 33, e.g. needles, are secured with one of their ends. The other end of each needle is free. The free end of the fibre bundle $\mathbf{30}_3$ projecting from the combing nippers 22, 23 contains fibres that are not clamped, which are removed by combing. Combing of the fibre bundle $\mathbf{30}_3$ is effected by motive engagement in the comb teeth 33 of the combing element 31.

Figure 8A:
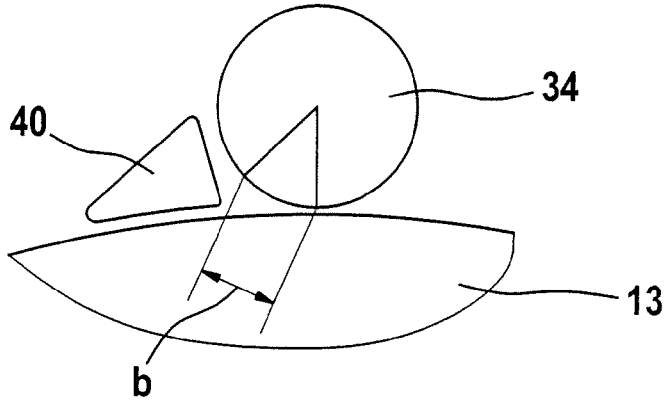
FIG. 8*a* to 8*c* show a holding-down element (FIG. 8*a*), cover element (FIG. 8*b*) and stripper element (FIG. 8*c*) for defined adjustment of the useful combing length.
Figure 8B:
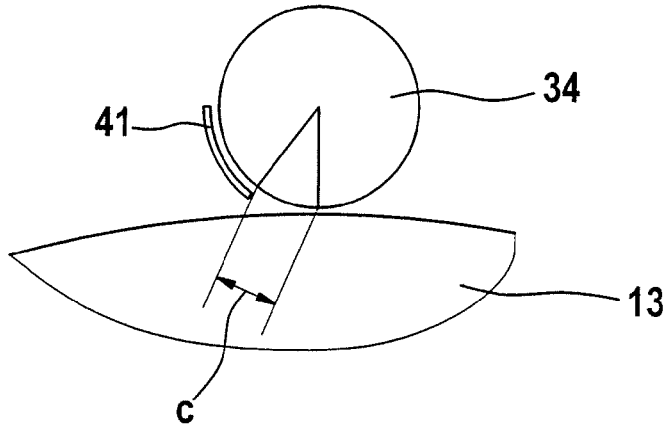
Figure 8C:
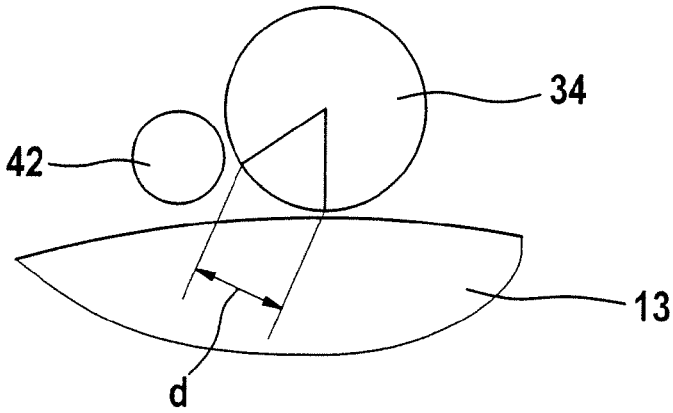

FIGS. 8*a* to 8*c* show arrangements suitable for adjusting the combing length in embodiments in which a circular comb is used as a combing element. When using a circular comb 34, lying opposite its surface is, according to FIG. 8*a*, a holding-down element 40, according to FIG. 8*b*, a cover element 41 or according to FIG. 8*c*, a stripping element 42, with the aim of adjusting the useful combed length in a defined manner. The useful combed length is denoted by reference letter b (FIG. 8*a*), c (FIG. 8*b*) and d (FIG. 8*c*) respectively.

Figure 9A:
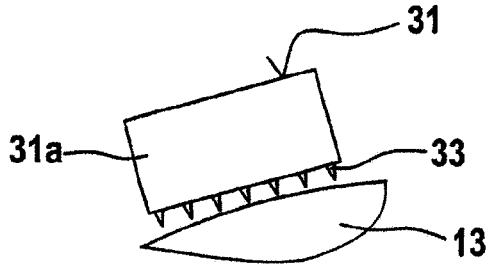
FIG. 9*a* and 9*b* show individual combing elements of straight (FIG. 9*a*) and curved (FIG. 9*b*) form.
Figure 9B:
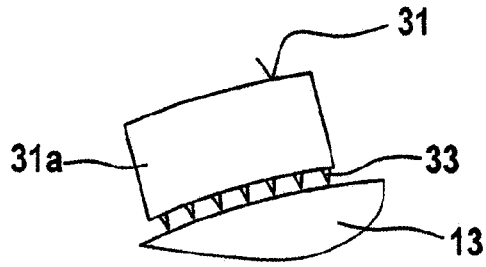

The combing teeth 33 of the combing element 31 can be aligned straight (FIG. 9*a*) or have a curved geometry (FIG. 9*b*), wherein according to FIG. 9*b* a constant combing nip is ensured over the entire circulation.

Figure 10A:
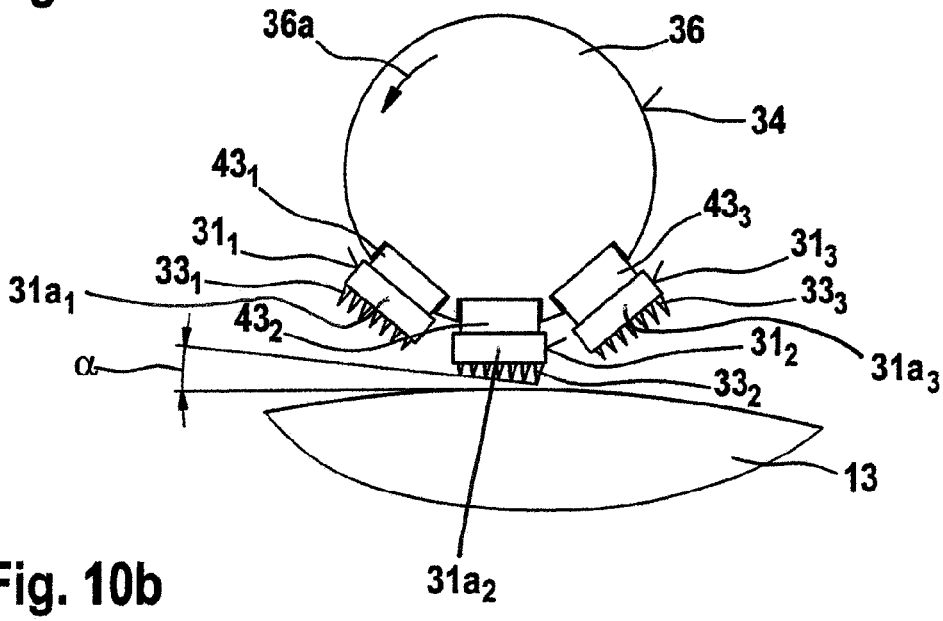
FIG. 10*a* shows a clothing with continuously increasing height in the combing segment.
Figure 10B:
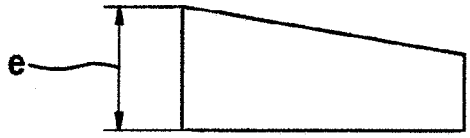
FIG. 10*b* shows the dependence of the combing nip on the combing length.
Figure 10C:
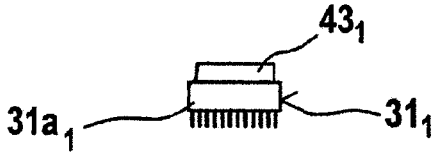
FIG. 10*c* shows a clothing mounted in a wedge-shaped intermediate element.
Figure 12:
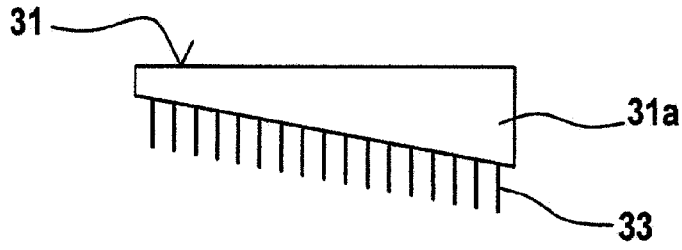
FIG. 12 shows combing segments having clothing of uniform height and wedge-shaped carrier element.

When using combing segments 31, these can be mounted, as shown in FIG. 12, in the form of a wedge on the surface. In this case, the carrier element 31*a* is of wedge-shaped construction and the combing teeth 33 are of the same height. According to FIGS. 10*a*, 10*b*, clothings $\mathbf{33}_1$ to $\mathbf{33}_3$, each with continuously increasing height (or free tooth or wire length), are inserted in respective combing elements $\mathbf{31}_1$ to $\mathbf{31}_3$ (compare FIG. 10*c*). The carrier elements $\mathbf{31}a_1$ to $\mathbf{31}a_3$ of the combing elements $\mathbf{31}_1$ to $\mathbf{31}_3$ are each secured via intermediate elements $\mathbf{43}_1$ to $\mathbf{43}_3$ in recesses 27 on the surface, e.g. of the circular comb 36. The height e of the intermediate elements $\mathbf{43}_1$ to $\mathbf{43}_3$ (see FIG. 10*b*) in the radial direction increases in the direction of rotation 36*a*, the effect being that the combing nip increases opposite to the direction of rotation 36*a*. In both embodiments (wedge-shaped arrangement and different height of the clothings), the plane of the free tips of the clothings 33 and a tangent to the periphery of the roller 13 form an angle α with one another. Both constructions allow, for example, a gentle combing.

Figure 11A:
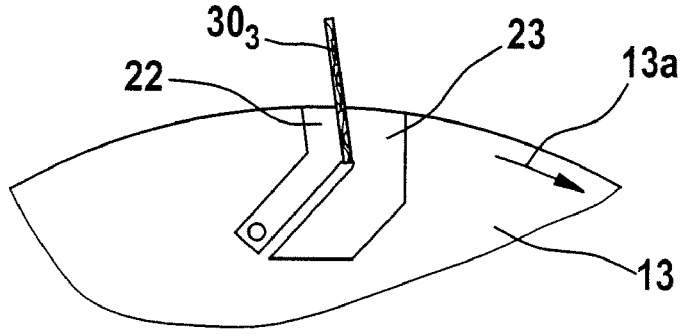
FIG. 11*a* to 11*c* show the influence of the nipper geometry on the fibre bundle feed.
Figure 11B:
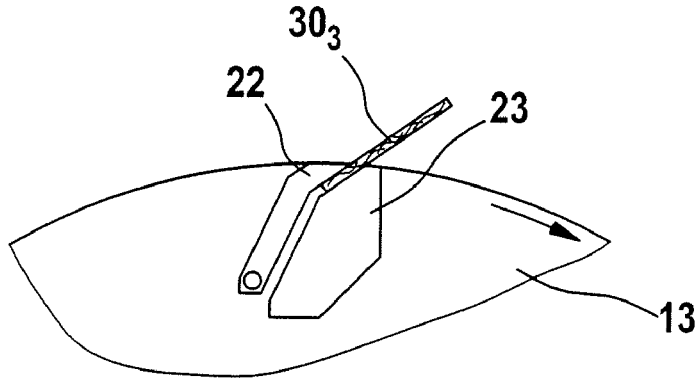
Figure 11C:
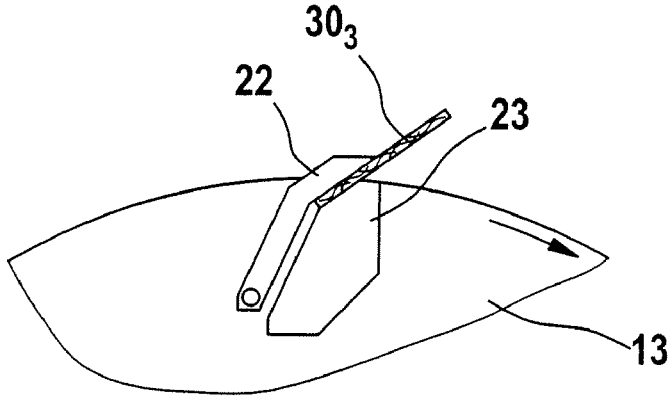

FIGS. 11*a* to 11*c* illustrated the influence of the nipper geometry on the feed of the fibre bundle. The upper nipper 22 and the lower nipper 23 have in their front end region profiles of complementary construction, by means of which, with the nipper assembly closed, they clamp an end region of the fibre tuft $\mathbf{30}_3$. The fibre bundle protruding in this clamped position from the nipper assembly is combed by a combing segment 31, e.g. of a circular comb 34. In this way, an optimum feed of the free end of the fibre bundle $\mathbf{30}_3$ to the combing element 31 is effected by virtue of the nipper geometry of the combing rotor nippers 21 (comprising upper nipper 22 and lower nipper 23) and hence by mechanical guidance.

Figure 13A:
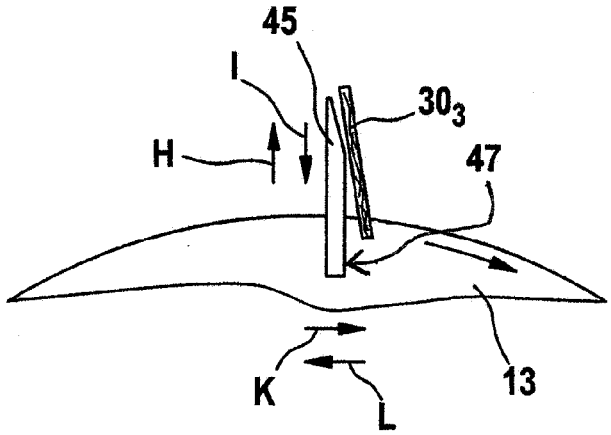
FIG. 13*a*, 13*b* show a slidable (13*a*) and pivotable (13*b*) guide element at the periphery of the combing rotor for optimal feed of the fibre bundle.
Figure 13B:
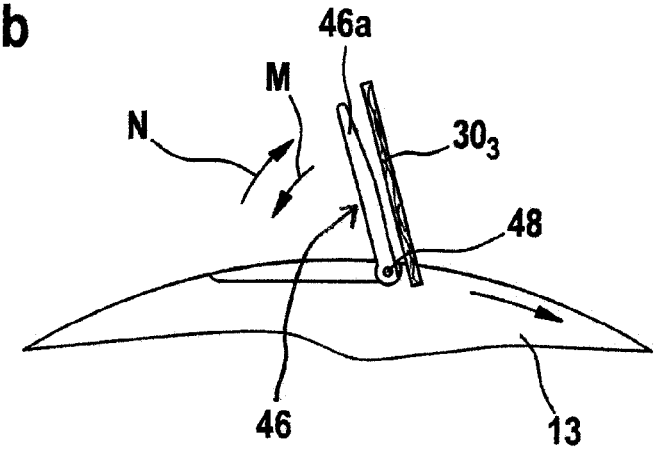

Optimum feed of the free end of the fibre bundle $\mathbf{30}_3$ can in other embodiments be effected by a slidable guide element 45 (FIG. 13*a*) or a pivotable guide element 46 (FIG. 13*b*) at the periphery of the combing rotor 13, that is to say by mechanical guidance. According to FIG. 13*a*, an end region of the guide element 45 is arranged in a groove 47 or the like on the periphery of the combing rotor 13 so as to slide in the direction of the arrows H, I. The guide element 45 can be arranged to slide (not shown) in the direction of the arrows K, L. According to FIG. 13*b*, the guide element has a blade 46*a* or the like, which is pivotable about a pivot bearing 48 in the direction of the arrows M, N.

Figure 14:
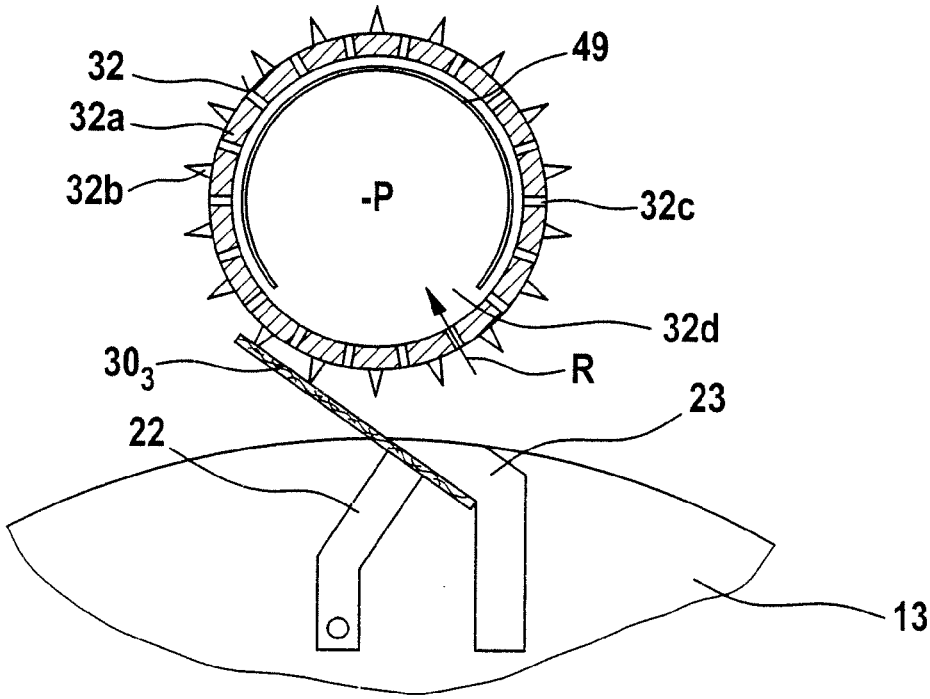
FIG. 14 shows a combing element with air passage openings, connected to a source of low pressure.
Figure 15:
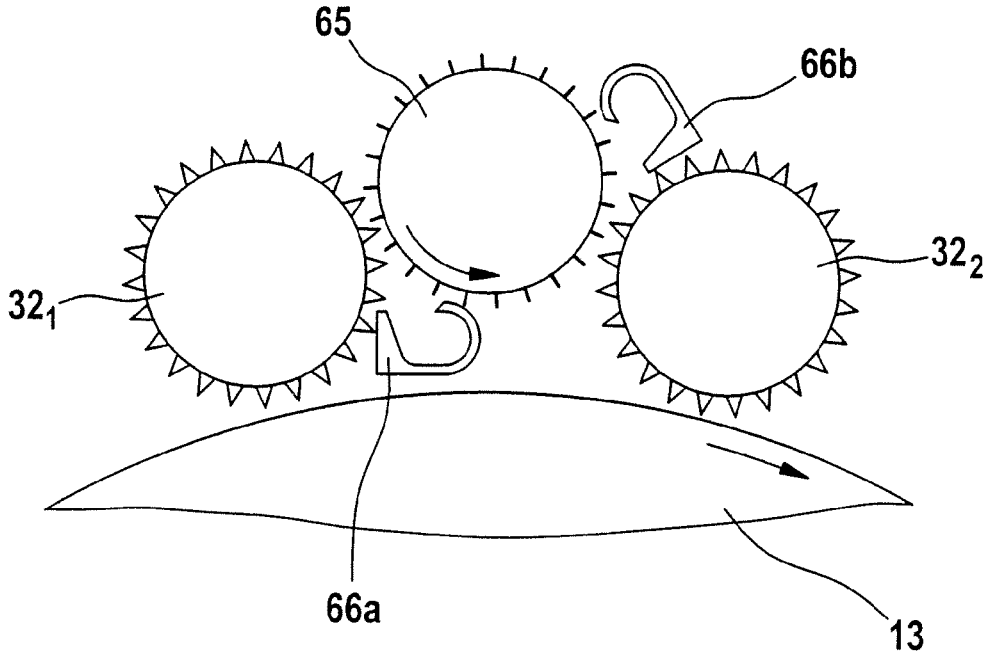
FIG. 15 shows the cleaning of a plurality of combing elements by a cleaning unit.

In the embodiment of FIG. 14, the combing element is in the form of a rotating combing roller 32. An optimum feed of the free end of the fibre bundle $\mathbf{30}_3$ to the combing element is effected as a result of the fact that the combing element (e.g. cylindrical surface 32*a* and clothing 36) is designed in such away that it has air passage openings 32*c* and its interior 32*d* is connected to a source of low pressure (not illustrated). The reference numeral 49 denotes a screen element, which screens off some of the air passage openings 32*c*. Air currents R pass from the outside into the interior 32*d* through the air passage openings 32*c* not covered over, drawing the free end of bundle $\mathbf{30}_3$ onto the combing roller 32 and thus straightening it.

When using combing segments 31, these can be mounted, as shown in FIG. 12, in the form of a wedge on the surface. In this case, the carrier element 31*a* is of wedge-shaped construction and the combing teeth 33 are of the same height. According to FIGS. 10*a*, 10*b*, clothings $\mathbf{33}_1$ to $\mathbf{33}_3$, each with continuously increasing height (or free tooth or wire length), are inserted in respective combing elements $\mathbf{31}_1$ to $\mathbf{31}_3$ (compare FIG. 10*c*). The carrier elements $\mathbf{31}a_1$ to $\mathbf{31}a_3$ of the combing elements $\mathbf{31}_1$ to $\mathbf{31}_3$ are each secured via intermediate elements $\mathbf{43}_1$ to $\mathbf{43}_3$ in recesses on the surface, e.g. of the circular comb 36. The height e of the intermediate elements $\mathbf{43}_1$ to $\mathbf{43}_3$ (see FIG. 10*b*) in the radial direction increases in the direction of rotation 36*a*, the effect being that the combing nip increases opposite to the direction of rotation 36*a*. In both embodiments (wedge-shaped arrangement and different height of the clothings), the plane of the free tips of the clothings 33 and a tangent to the periphery of the roller 13 form an angle a with one another. Both constructions allow, for example, a gentle combing.

Figure 16:
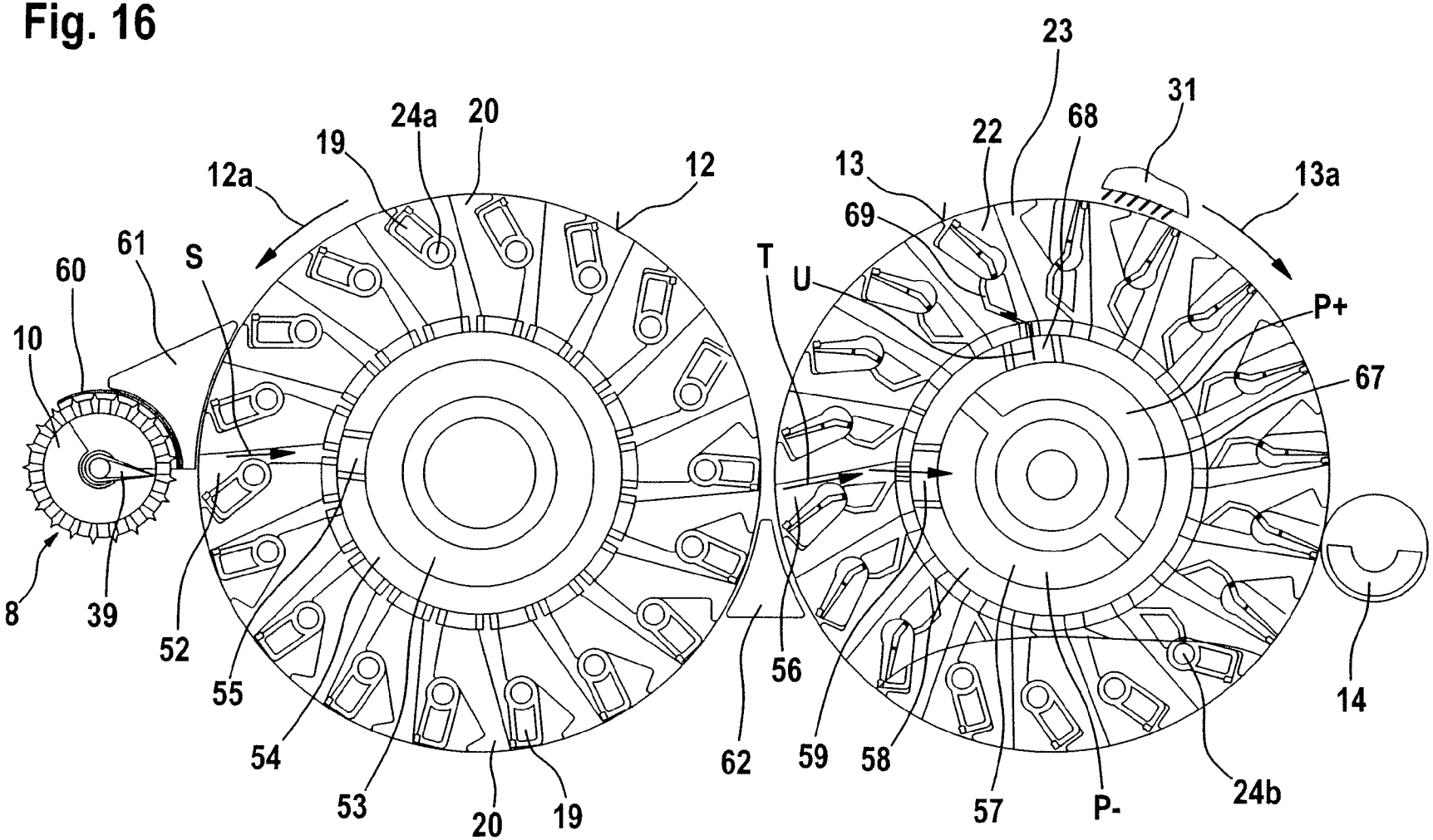
FIG. 16 shows a rotor combing machine of generally similar construction to that in FIG. 2, in which suction devices are associated with the clamping devices for take up, and pressure devices are associated with the clamping devices for positioning and feed to the combing element.

FIG. 16 shows a rotor combing machine as in FIG. 2, in which suction devices 52 and 53 are associated with the clamping devices 18 of the first roller 12 and with the clamping devices 21 of the second roller 13 respectively. According to FIG. 16, the rotatably mounted rollers 12 and 13 with clamping devices 19, 20 and 22, 23 are equipped additionally with suction channels 52 and 56, respectively (suction openings), which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is a reduced pressure region 53 to 55 and 57 to 59, respectively, created by the suction flow S and T respectively at the suction openings 52, 56. The reduced pressure can be generated by connecting to a flow-generating machine. The suction flow at the individual suction openings 52, 56 can be so switched between reduced pressure region and suction opening that it is applied only at particular selected angular positions on the roller circumference. For the purpose of the switching, valves or a valve pipe 54, 58 with openings 57 and 59, respectively, in the corresponding angular positions can be used. The release of the suction flow may also be brought about by the movement of the gripping element (upper nipper). Furthermore, it is possible to arrange a region of reduced pressure only at the corresponding angular positions.

Additionally, a blowing flow can be provided in the region of the supply device 8 and/or in the region of transfer between the rollers. The source of the blowing flow (blowing nozzle 39) is arranged inside the feed roller 10 and has effect, through the air-permeable surface of the supply device or air passage openings, towards the outside in the direction of the first roller. Also, in the region of the supply device 8, the element for producing the blown air current can be fixedly arranged, directly under or over the supply device 8. In the region of the transfer between the rollers 12, 13 the blown air current sources can be arranged at the perimeter of the first roller 12, directly under or over each nipper device. For the blown air generation there may be used compressed air nozzles or air blades.

In the embodiment of FIG. 14, the combing element is in the form of a rotating combing roller 32. An optimum feed of the free end of the fibre bundle $\mathbf{30}_3$ to the combing element is effected as a result of the fact that the combing element (e.g. cylindrical surface 32*a* and clothing 32*b*) is designed in such a way that it has air passage openings 32*c* and its interior 32*d* is connected to a source of low pressure −P (not illustrated). The reference numeral 49 denotes a screen element, which screens off some of the air passage openings 32*c*. Air currents R pass from the outside into the interior 32*d* through the air passage openings 32*c* not covered over, drawing the free end of bundle $\mathbf{30}_3$ onto the combing roller 32 and thus straightening it.

As a result of the provision of additional air guide elements 60 and lateral screens 61, 62 the direction of the flow can be influenced and the air carried round with the rotors separated off. In that way the time for alignment can be further shortened. In particular, a screen element between the first rotor 12 and supply device 8 over the lap and a screen element on each side of the roller have proved useful.

FIG. 16 shows a rotor combing machine as in FIG. 2, in which suction devices 52 and 53 are associated with the clamping devices 18 of the first roller 12 and with the clamping devices 21 of the second roller 13 respectively. According to FIG. 16, the rotatably mounted rollers 12 and 13 with clamping devices 19, 20 and 22, 23 are equipped additionally with suction channels 52 and 56, respectively (suction openings), which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is a reduced pressure P− region 53 to 55 and 57 to 59, respectively, created by the suction flow S and T respectively at the suction openings 52, 56. The reduced pressure can be generated by connecting to a flow-generating machine. The suction flow at the individual suction openings 52, 56 can be so switched between reduced pressure region and suction opening that it is applied only at particular selected angular positions on the roller circumference. For the purpose of the switching, valves or a valve pipe 54, 58 with openings 57 and 59, respectively, in the corresponding angular positions can be used. The release of the suction flow may also be brought about by the movement of the gripping element (upper nipper). Furthermore, it is possible to arrange a region of reduced pressure only at the corresponding angular positions.

Figure 16A:
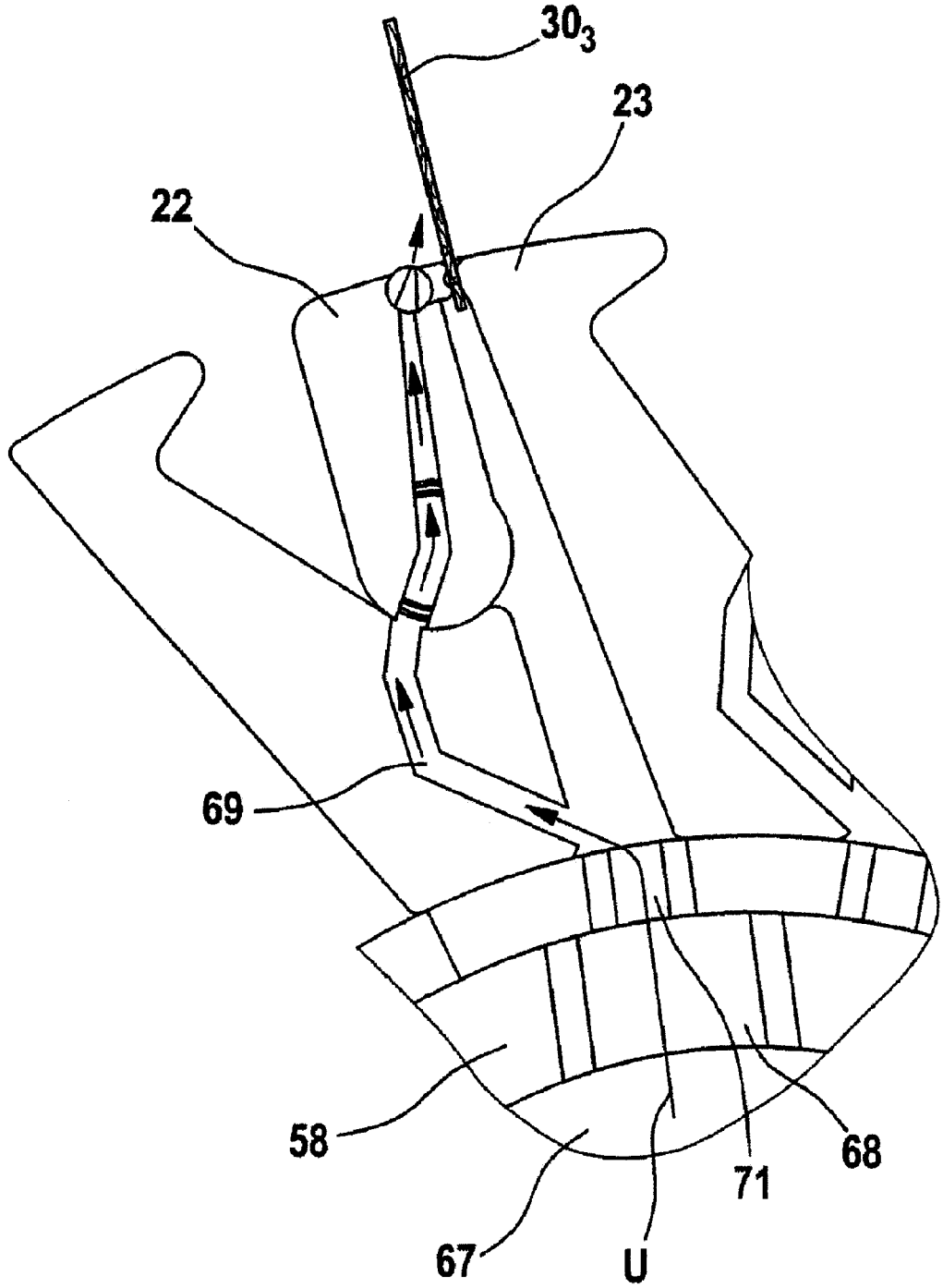
FIG. 16*a* shows to an enlarged scale a cut-out from FIG. 16, with pressure line and blown air current for optimal feed of the fibre bundle to the combing element.

In the interior of the rotor 13 there is an increased pressure region 67, which generates a pressure flow U at a pressure opening 68. The increased pressure can be generated by connecting to a flow-generating machine. The pressure flow at the pressure opening 68 can be so switched between increased pressure region and pressure opening 68 that it is applied only at particular selected angular positions on the roller periphery. For the purpose of the switching, valves or the valve pipe 58 with the pressure opening 68 in the corresponding angular positions can be used. The pressure opening 68 is connected to an air passage opening 71. Furthermore, it is possible to arrange a region of increased pressure only at the corresponding angular positions. In the region between the valve pipe 58 and the outer periphery of the roller 13, associated with each nipper pair 21 is a pressure line 69, which passes through the lower nipper 23 and the upper nipper 22 (see FIG. 16*a*). In the region just before the combing element 31—viewed in the direction of rotation 13*a* of the roller 13—the one open end of the pressure line 69 currently located at that point is in connection with the pressure opening 68 and the other open end is in connection with the atmosphere. The pressure flow U passes via the pressure opening 68 right through the pressure line 69 and blows onto the free end of the fibre bundle, which thus moves away from the surface of the roller 13 and becomes aligned to a certain extent (see FIG. 16*a*). The free end of the fibre bundle $\mathbf{30}_3$ thus positioned is fed to the combing element 31 and mechanically combed out in the manner shown in FIG. 7.

Using the rotor combing machine 2 according to the invention, more than 2000 nips/min, for example from 3000 to 5000 nips/min, are achieved.

In use of the rotor combing machine according to the invention there is achieved a mechanical combing of the fibre material to be combed out, that is, mechanical means are used for the combing. There is no pneumatic combing of the fibre material to be combed, that is, no air currents, e.g. suction and/or blown air currents, are used for combing.

In the rotor combing machine according to the invention there are present rollers that rotate rapidly without interruption (continuously) and that have clamping devices. Rollers that rotate with interruptions, stepwise or alternating between a stationary and rotating state are not used.

In the interior of the rotor 13 there is an increased pressure P+ region 67, which generates a pressure flow U at a pressure opening 68. The increased pressure can be generated by connecting to a flow-generating machine. The pressure flow at the pressure opening 68 can be so switched between increased pressure region and pressure opening 68 that it is applied only at particular selected angular positions on the roller periphery. For the purpose of the switching, valves or the valve pipe 58 with the pressure opening 68 in the corresponding angular positions can be used. The pressure opening 68 is connected to an air passage opening 71. Furthermore, it is possible to arrange a region of increased pressure only at the corresponding angular positions. In the region between the valve pipe 58 and the outer periphery of the roller 13, associated with each nipper pair 21 is a pressure line 69, which passes through the lower nipper 23 and the upper nipper 22 (see FIG. 16*a*). In the region just before the combing element 31—viewed in the direction of rotation 13*a* of the roller 13—the one open end of the pressure line 69 currently located at that point is in connection with the pressure opening 68 and the other open end is in connection with the atmosphere. The pressure flow U passes via the pressure opening 68 right through the pressure line 69 and blows onto the free end of the fibre bundle, which thus moves away from the surface of the roller 13 and becomes aligned to a certain extent (see FIG. 16*a*). The free end of the fibre bundle $\mathbf{30}_3$ thus positioned is fed to the combing element 31 and mechanically combed out in the manner shown in FIG. 7.

Although the foregoing invention has been described in detail by way of illustration and example for purposes of understanding, it will be obvious that changes and modifications may be practised within the scope of the appended claims.

What we claim is:

1. An apparatus for the fibre-sorting or fibre-selection of a fibre bundle comprising textile fibres, the apparatus comprising:

a fibre-sorting device comprising at least a first roller and a second roller that rotate rapidly without interruption when in use, at least the second roller having clamping devices distributed about its periphery, the clamping devices adapted to clamp a fibre bundle;

a supply device adapted to supply the fibre bundle to the fibre-sorting device;

at least one combing device associated with the second roller, wherein the combing device combs the fibre bundle in order to loosen and remove non-clamped constituents from the fibre bundle; and a pneumatic guide device adapted for optimum feed and/or positioning of the fibre material to be combed associated with the at least one combing device.

2. An apparatus according to claim 1, wherein the pneumatic guide device comprises a suction device.

3. An apparatus according to claim 1, wherein the pneumatic guide device comprises a blowing device.

4. An apparatus according to claim 1, wherein the combing device comprises fewer combing elements than clamping elements that cooperate with the combing elements.

5. An apparatus according to claim 1, further comprising additional elements integrated in the second roller, the additional elements adapted for optimum fibre bundle feed.

6. An apparatus according to claim 1, wherein the fibre bundle is stationary in relation to the clamping site on said second roller during feed to the combing device.

7. An apparatus according to claim 1, wherein the combing device has a plurality of combing elements adapted to comb the fibre bundle and, to achieve an optimum combing result, the directions of rotation of the combing elements and the speed ratios are adjustable.

8. An apparatus according to claim 1, further comprising at least one of a stripper element, a cover element, or a holding-down element adapted to adjust the useful combing length.

9. An apparatus according to claim 1, further comprising a source of air jetting from the second roller for optimum feed of the fibre bundle to one or more combing element of the combing device.

10. An apparatus according to claim 9, wherein the pressure and/or angle of the air jetting is adjustable.

11. An apparatus according to claim 9, wherein the second roller comprises nozzles for effecting said air jetting, and the position of the nozzles is adjustable.

12. An apparatus for the fibre-sorting or fibre-selection of a fibre bundle comprising textile fibres, the apparatus comprising:

a fibre-sorting device comprising at least a first roller and a second roller that rotate rapidly without interruption when in use, at least the second roller having clamping devices distributed about its periphery, the clamping devices adapted to clamp a fibre bundle;

a supply device adapted to supply the fibre bundle to the fibre-sorting device;

at least one combing device associated with the second roller, wherein the combing device combs the fibre bundle in order to loosen and remove non-clamped constituents from the fibre bundle; and an externally mounted nozzle arrangement for emitting an air jet for optimum feed of the fibre bundle to a combing element of the combing device.

13. An apparatus according to claim 12, wherein the externally mounted nozzle arrangement comprises nozzles having an adjustable pressure, angle, and/or position.

14. An apparatus for the fibre-sorting or fibre-selection of a fibre bundle comprising textile fibres, the apparatus comprising:

a fibre-sorting device comprising at least a first roller and a second roller that rotate rapidly without interruption when in use, at least the second roller having clamping devices distributed about its periphery, the clamping devices adapted to clamp a fibre bundle;

a supply device adapted to supply the fibre bundle to the fibre-sorting device;

at least one combing device associated with the second roller, wherein the combing device combs the fibre bundle in order to loosen and remove non-clamped constituents from the fibre bundle; and a positioning device adapted for optimum feed and/or positioning of the fibre material to be combed associated with the at least one combing device;

wherein said clamping devices comprise a multiplicity of nippers, having a nipper geometry adapted to provide mechanical guidance for an optimum feed of the fibre bundle to combing elements of the combing device.

15. An apparatus according to claim 1, further comprising guide elements at the periphery of the second roller, the guide elements adapted to provide mechanical guidance of the fibre bundle to the combing element for an optimum feed of the fibre bundle to the combing element.

16. An apparatus according to claim 15, wherein the guide elements have an adjustable spacing and/or position with respect to the second roller.

17. An apparatus for the fibre-sorting or fibre-selection of a fibre bundle comprising textile fibres, the apparatus comprising:

a fibre-sorting device comprising at least a first roller and a second roller that rotate rapidly without interruption when in use, at least the second roller having clamping devices distributed about its periphery, the clamping devices adapted to clamp a fibre bundle;

a supply device adapted to supply the fibre bundle to the fibre-sorting device;

at least one combing device associated with the second roller, wherein the combing device combs the fibre bundle in order to loosen and remove non-clamped constituents from the fibre bundle; and guide elements at the periphery of the second roller, the guide elements adapted to provide mechanical guidance of the fibre bundle to the combing element for an optimum feed of the fibre bundle to the combing element, wherein the guide elements are retractable into the second roller during the combing process.

18. An apparatus for the fibre-sorting or fibre-selection of a fibre bundle comprising textile fibres, the apparatus comprising:

a fibre-sorting device comprising at least a first roller and a second roller that rotate rapidly without interruption when in use, at least the second roller having clamping devices distributed about its periphery, the clamping devices adapted to clamp a fibre bundle;

a supply device adapted to supply the fibre bundle to the fibre-sorting device;

at least one combing device associated with the second roller, wherein the combing device combs the fibre bundle in order to loosen and remove non-clamped constituents from the fibre bundle; and air outlet openings in a combing element and/or clothing of the combing device, the air outlet openings connected to a source of reduced pressure for optimum feed of the fibre bundle to the combing element of the combing device.

19. An apparatus according to claim 18, wherein the source of reduced pressure is adjustable.

20. An apparatus according to claim 18, wherein the combing element is continuously acted upon by suction.

21. An apparatus according to claim 18, wherein the combing element is acted upon by suction on a timed basis.

22. An apparatus for the fibre-sorting or fibre-selection of a fibre bundle comprising textile fibres, the apparatus comprising:

a fibre-sorting device comprising at least a first roller and a second roller that rotate rapidly without interruption when in use, at least the second roller having clamping devices distributed about its periphery, the clamping devices adapted to clamp a fibre bundle;

a supply device adapted to supply the fibre bundle to the fibre-sorting device;

at least one combing device associated with the second roller, wherein the combing device combs the fibre bundle in order to loosen and remove non-clamped constituents from the fibre bundle; and a positioning device adapted for optimum feed and/or positioning of the fibre material to be combed associated with the at least one combing device;

wherein the at least first and second rollers comprise a turning rotor as said first roller and a combing rotor as said second roller, the turning rotor and the combing rotor having opposite directions of rotation.

23. An apparatus for the fibre-sorting or fibre-selection of a fibre bundle comprising textile fibres, the apparatus comprising:

a fibre-sorting device comprising at least a first roller and a second roller that rotate rapidly without interruption when in use, at least the second roller having clamping devices distributed about its periphery, the clamping devices adapted to clamp a fibre bundle;

a supply device adapted to supply the fibre bundle to the fibre-sorting device;

at least one combing device associated with the second roller, wherein the combing device combs the fibre bundle in order to loosen and remove non-clamped constituents from the fibre bundle; and at least one suction device associated with the clamping devices in the region of the take-up of the fibre bundle from the supply device to the to the first roller and/or in the region of the transfer of the fibre material from the first roller to the second roller.

* * * * *